US008857679B2

(12) United States Patent
Skerman

(10) Patent No.: US 8,857,679 B2
(45) Date of Patent: Oct. 14, 2014

(54) APPLICATOR FOR COMPRESSION STOCKINGS AND THE LIKE

(76) Inventor: Robert Graham Mitchell Skerman, Kholo (AU)

( * ) Notice: Subject to any disclaimer, the term of this patent is extended or adjusted under 35 U.S.C. 154(b) by 1048 days.

(21) Appl. No.: 12/524,764

(22) PCT Filed: Jan. 30, 2007

(86) PCT No.: PCT/AU2007/000083

§ 371 (c)(1),
(2), (4) Date: Jan. 28, 2010

(87) PCT Pub. No.: WO2007/085061

PCT Pub. Date: Aug. 2, 2007

(65) Prior Publication Data

US 2010/0147908 A1 Jun. 17, 2010

(51) Int. Cl.
*A47G 25/80* (2006.01)
*A47G 25/90* (2006.01)

(52) U.S. Cl.
CPC ..... *A47G 25/905* (2013.01); *A47G 25/908* (2013.01)
USPC ..... 223/111

(58) Field of Classification Search
USPC ..... 223/111–113, 114–119
See application file for complete search history.

(56) References Cited

U.S. PATENT DOCUMENTS

| | | | | |
|---|---|---|---|---|
| 4,130,226 | A | 12/1978 | Farrell | |
| 4,238,061 | A * | 12/1980 | Marchetti et al. | 223/111 |
| 4,260,083 | A * | 4/1981 | Aslin | 223/111 |
| 4,765,520 | A * | 8/1988 | Barton | 223/111 |
| 5,069,374 | A | 12/1991 | Williamson | |
| 5,630,534 | A * | 5/1997 | Maier et al. | 223/112 |
| 5,632,424 | A * | 5/1997 | Maier et al. | 223/112 |
| 5,826,761 | A * | 10/1998 | Basaj | 223/112 |
| 6,234,369 | B1 * | 5/2001 | Bort | 223/112 |
| 7,070,074 | B2 * | 7/2006 | Landsberger et al. | 223/113 |
| 7,364,056 | B2 * | 4/2008 | Boaron | 223/111 |
| 8,393,503 | B2 * | 3/2013 | Moscato | 223/112 |
| 2004/0104254 | A1 * | 6/2004 | Klammer | 223/112 |

FOREIGN PATENT DOCUMENTS

| | | |
|---|---|---|
| CA | 1079238 | 6/1980 |
| DE | 1009764 | 6/1957 |
| DE | 4228916 | 3/1994 |

(Continued)

OTHER PUBLICATIONS

European Patent Office, Extended European Search Report for EP Application No. 07701416.5, Dec. 15, 2010, Examiner Marco Tempels, The Hague.

*Primary Examiner* — Clinton T Ostrup
*Assistant Examiner* — Andrew W Sutton
(74) *Attorney, Agent, or Firm* — Stites & Harbison PLLC; Douglas E. Jackson

(57) ABSTRACT

An applicator for applying compression stockings and bandages to the limb of a user. The applicator includes a rigid tubular body, an open top with a rim, an open base and a passageway between the base and top. The applicator includes two or more longitudinal slots in the side wall of the tubular body for use in loading. An anterior notch allows an ergonomic application of the stocking and loading. The applicator may be formed in two parts for variation of its internal dimension. It preferably includes a foot arch. The applicator may be adapted for removal of the stocking. The invention extends to a method of donning and removing a compression stocking.

17 Claims, 6 Drawing Sheets

(56) References Cited

FOREIGN PATENT DOCUMENTS

| | | |
|---|---|---|
| DE | 20302769 | 2/2003 |
| DE | 20306424 | 7/2003 |
| DE | 10315870 | 12/2004 |
| EP | 1576910 | 9/2005 |
| GB | 2338172 | 12/1999 |
| NL | 9000361 | 9/1991 |
| NL | 1030635 | 2/2006 |

* cited by examiner

APPLICATOR FOR COMPRESSION STOCKINGS AND THE LIKE

FIELD OF THE INVENTION

The present invention relates to an applicator and method for applying compression stockings, compression bandages and other elasticised stockingettes to the limbs of a wearer. The present invention is particularly well suited to application and removal of compression stockings in the elderly but is not so limited.

BACKGROUND

Compression stockings and compression bandages are widely used on the arms and legs of people suffering from various medical conditions. The compression stockings are well suited to treat, minimize or prevent odema in the legs, particularly of people suffering from congestive cardiac failure. Stockings and compression stockings are also well suited to treatment of varicose veins, some ulcers and some forms of vasulitis. Compression bandages are often used to minimize scarring in burns case and to prevent bleeding and seepage from open wounds.

While there are many therapeutic indications for the use of compression stockings, their use is not without its challenges. Compression stockings come in a variety of sizes and, with reference to the legs, they may vary in diameter and length for use below the knee or to mid-thigh. Further, the degree of compression provided by these bandages is graded into progressive classes of decreasing elasticity and associated compression. While subsequent discussion will be restricted to compression stockings, it should be understood that this expression extends to various types of stockings, compression bandages and the like for the purposes of this specification.

Application of compression stockings requires the exertion of considerable effort and the use of digital and hand strength. This is often beyond the capacity of elderly users of compression stockings providing the unacceptable situation where the compression stockings could provide great benefit but they are unable to be applied. Non compliance with treatment regimes involving the application of compression stockings by patients is common and is recognised as a major factor in recurrence of a variety of treatable community health issues.

One response of health systems is to allot time for community nurses or similar to visit patients in their residences and apply the compression stockings. However, they must then revisit that patient to remove the compression stocking at the end of the day or after a suitable period of time. A further risk in application of the stockings arises from the often devitalized nature of the skin of elderly patients. The risk of bruising and skin breakage is high when manipulating a compression stocking on to a limb manually. This can be a considerable problem with a predisposition to developing ulceration magnified by poor micro-circulation in the area.

There is also a significant economic detriment in having to fund the attendance of a community nurse many times at a patient's home. A significant percentage of the budget of many community health schemes is directed towards providing assistance to patients to apply and subsequently remove compression stockings. It is known to use some devices for pre-loading compression stockings for application to a limb. These devices vary in their degree of difficulty of use associated with loading the compression stocking, their physical size, accessibility of the limb to the device, and transportability. In addition, such devices do not provide a method of removing the compression stocking from the limb.

It would be of benefit to provide a solution, even if partial, to this dilemma.

SUMMARY OF THE INVENTION

In a first aspect, although not necessarily the only or indeed the broadest aspect, the invention resides in an applicator for compression stockings, bandages and the like, the applicator comprising:

- a rigid tubular body;
- an open top with a rim;
- an open base;
- a passageway between the top and the base of sufficient dimensions to allow passage of a limb of a person; and
- two or more longitudinal slots dimensioned to allow use of fingers and/or a hand to load the applicator with the compression stocking or bandage.

Preferably the applicator is oval or cylindrical. In one form, the body may be made of any suitable material, preferably of a smooth nature facilitating sliding of the compression stocking on and off the applicator. The body may be formed from a metal or a polymeric material.

The body may be formed in two inter-engagable parts which are separable.

The top preferably includes an outwardly flared rim at least in part. The rim may be formed with an anterior section, an intermediate section and a posterior section. The rim preferably includes a notch extending downwardly and dimensioned to facilitate loading of the compression stocking or bandage on to the applicator. The notch may be in the anterior section.

The intermediate section of the rim is preferably slightly convex.

The rim is preferably outwardly flared in the posterior section to initially anchor the stocking during loading. The rim in the anterior section may also be outwardly flared. The flare should be sufficient to provide retentive friction to the compression stocking when loading.

The slots are preferably opposed and in a cylindrical version may be diametrically opposed. There are preferably two slots but may be four or more. The slots are longitudinally extending. An upper end of each slot may be expanded to permit easier gripping of the compression stocking when loading the applicator.

The base may be flared to provide a barrier to limit the downward travel of the stocking when loading.

The base preferably includes an anterior foot opening preferably a foot arch to facilitate passage of the foot and ankle of a user. The foot arch may be bracketed by forward reaching tongues to help stabilise the applicator when standing on the base.

The applicator preferably includes two spaced handles, the handles engaged with the body at or around the base. The handles may be flexible. The handles are preferably dimensioned to extend upward in variable length for use by a person self applying the compression stocking to their leg. The handles may be formed from a flexible cord and may be nylon or other hard wearing resistant synthetic. The handles may be removable.

The applicator preferably includes attachment means for attaching a removal device for removing the stocking. The attachments means may comprise two opposed mounting points adjacent or near the base. The mounting points may be lugs adapted to receive a yoke or other arrangement to assist in removal of the stocking. The applicator may include a flexible yoke for removable engagement with the lugs. The flexible yoke may be continuous with a cord for applying traction to the body when removing the compression stocking. The flexible cord may be engaged with a pulley or pulley system for fixing to a static point and providing the ability for a person to remove their own compression stocking.

The applicator preferably further includes one or more removal retaining clips which are removably engageable with the rim to thereby clamp an upper section of the compression stocking to the body and allow removal by movement of the body with stocking attached away from a user. Preferably two removal retaining clips are provided for clip fit between the top of each slot and adjacent rim. Alternatively the clips may comprise two opposable lockable jaws.

In a further aspect, the invention may reside in a method of donning a compression stocking, the method comprising the steps of:

- loading a compression stocking onto a tubular applicator by inverting the stocking onto an outside surface of the applicator while positioning a terminal section of the compression stocking within a passageway of the tubular applicator;
- locating a foot or hand of a user in or through the terminal section;
- urging the applicator along a limb of the user allowing the loaded compression stocking to deposit onto the limb;
- removing the tubular applicator after the entire compression stocking has been discharged.

The method may further include the steps of loading the compression stocking on the applicator by:

- lowering the compression stocking into the passageway of the applicator in alignment with the limb of the user;
- locating an inverted edge of an uppermost section of the compression stocking behind a lip of the posterior rim of the applicator;
- and stretching the compression stocking forwardly and downwardly over a notch in the rim; and
- gripping the compression stocking in two opposed slots with fingers and palms and urging extra compression stocking onto the outside wall of the body until a terminal section of the compression stocking is in place at the top of the applicator. This may be the heel of the compression stocking.

The method may further include removing the stocking from a limb of a user, by:

- placing the limb bearing the stocking into the applicator;
- attaching an upper inverted section of the compression stocking to the top section of the applicator using removable clips;
- pulling the applicator off the limb of the user and away from the user to thereby turn the compression stocking inside out and remove it from the limb.

The method may also include the step of attaching a cord to or around a base of the applicator and applying traction force to the applicator preferably by engaging the cord through a pulley system back to the user to remove the compression stocking.

DETAILED DESCRIPTION OF THE DRAWINGS

Figure 1:
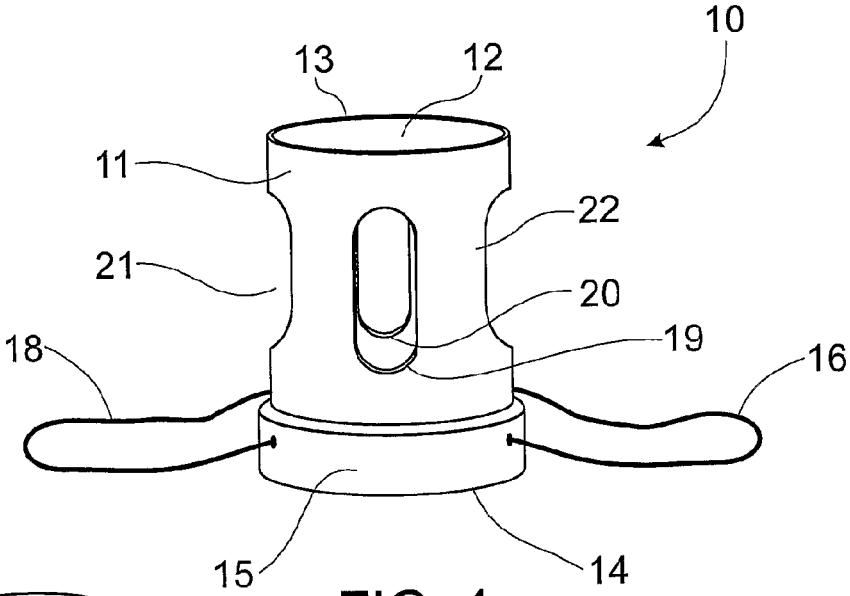
FIG. 1 is an upper perspective view of a first embodiment of an applicator of the present invention.

Referring first to FIG. 1, there is seen an applicator 10 comprising a rigid body 11 having an open top 12 with rim 13 and base 14. The base has a flared collar 15. Two flexible handles 16, 18 are shown attached at or adjacent to the base. Four longitudinal slots 19, 20, 21, 22 are shown arranged in a diametrically opposed pairs. The base 14 is also open.

Figure 2:
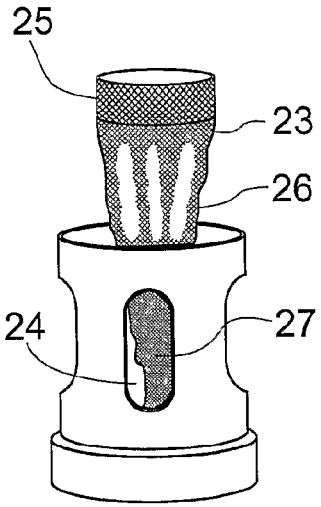
FIG. 2 shows a compression stocking located in the passageway of the applicator or FIG. 1.

In FIG. 2, a compression stocking 23 is positioned in passageway 24 between the open top 12 and open base 14. The compression stocking may also be a compression bandage or other elasticised product for application to a limb of a user. The compression stocking 23 has a top section 25, a middle section 26 and foot 27.

Figure 3:
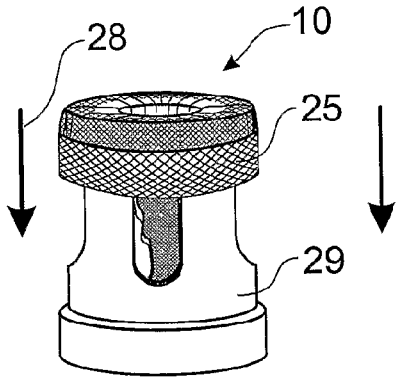
FIG. 3 shows an upper section of a stocking stretched over and partially down an outer wall of the applicator.

In FIG. 3 the top section 25 of the stocking has been stretched and urged downwardly in the direction of arrow 28 and onto outer wall 29 of the applicator 10.

Figure 4:
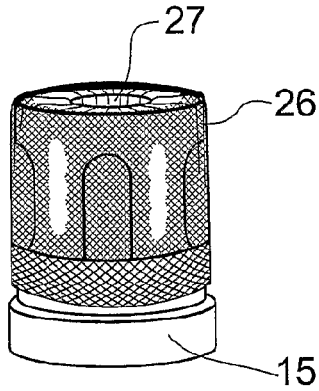
FIG. 4 shows the stocking gathered onto the outside of the applicator.
Figure 5:
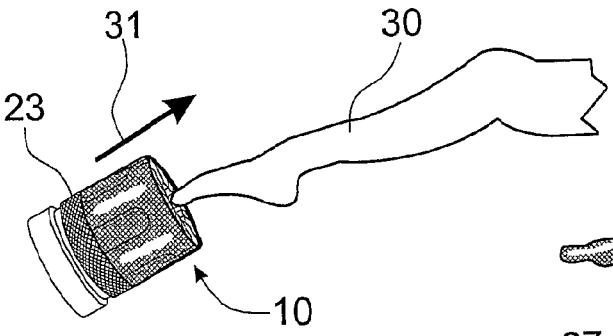
FIG. 5 shows a leg of a user aligned with the centre of the passageway.
Figure 6:
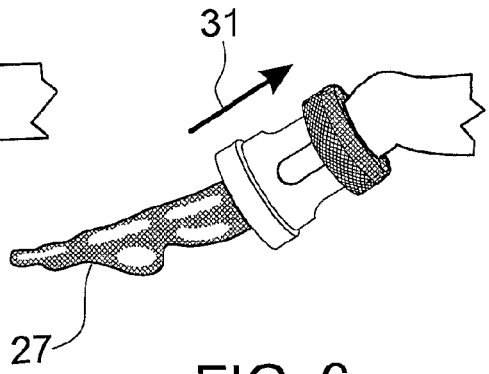
FIG. 6 shows the applicator moved up the leg and having discharged a significant portion of the compression stocking.

In FIG. 4 the middle section 26 of the compression stocking 23 is also urged downwardly by a user locating their fingers in the slots, preferably opposed slots, gathering the compression stocking against the palm and urging it down. The flared collar 15 acts as a stop to movement of the compression stocking.

The foot section 27 is automatically centred by even application of the compression stocking onto the outer wall 29.

Once loaded a leg or a other limb of a user 30 is aligned with the loaded applicator 10 and stocking 23 which is then urged in direction of arrow 31. As the applicator is advanced the foot engages the foot section 27 of compression stocking and further upward movement leads to the compression stocking simply slipping off the outer surface of the applicator under tension to thereby provide an even tensioned unloading of the compression stocking onto the limb. Simplicity and advantage of the device is readily apparent. A person may self apply the compression stocking by using the flexible handles 16, 18 which are not shown in FIGS. 2-6 but may be easily added in operation. The handles may be variable in length.

Figure 7:
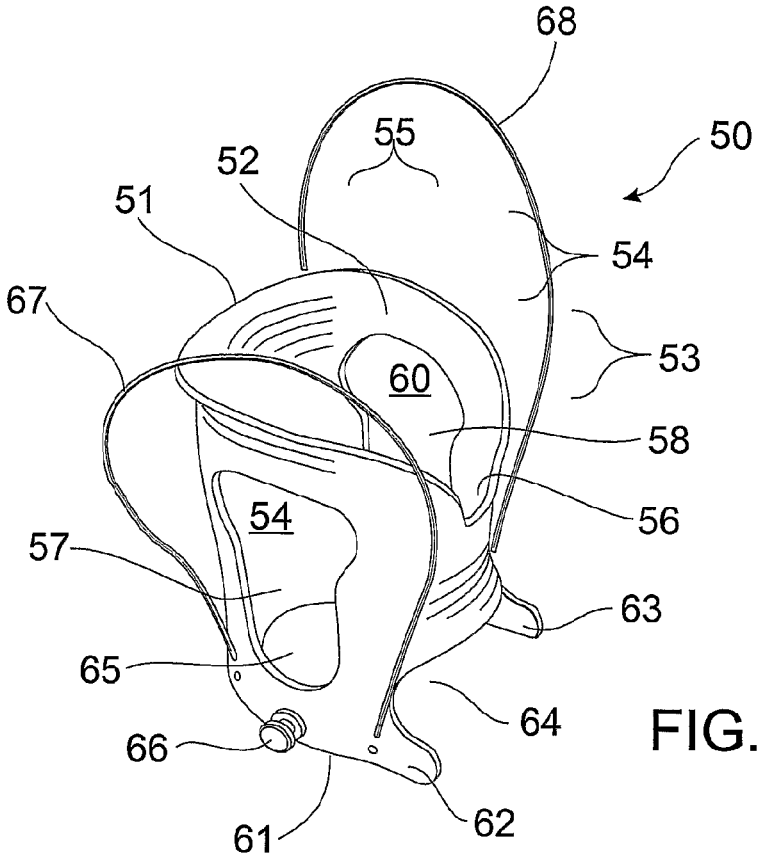
FIG. 7 is a perspective view of a second embodiment of the invention.

FIG. 7 shows a second embodiment of an applicator 50 of the present invention. In this applicator, the rim 51 of the open top 52 may be considered as comprising three sections being an anterior section 53, intermediate section 54 and posterior section 55. The anterior section 53 has a notch 56 extending downwardly. The posterior section 55 has an outwardly flared lip and the intermediate section 54 is slightly convex and may also have a flared lip. The notch placed anteriorly provides the most efficient operation but it is possible to place the notch elsewhere. The anterior section may be also flared.

The applicator 50 has two longitudinal slots 57, 58 which are diametrically opposed and expanded in their uppermost sections 59, 60. The base 61 has two forwardly extending tongues 62, 63 which bracket a foot arch 64 in the anterior wall. The base 61 is open to provide a passageway 65 through the bottom of the applicator.

Two opposed lugs are formed or mounted adjacent to the base. The right hand lug 66 is visible and the left hand lug is not visible but is opposed to the right hand lug and on the opposite side of the applicator.

Two flexible and adjustable handles 67, 68 are provided and are engaged at or adjacent the base of the applicator. The handles may be removable.

Figure 8:
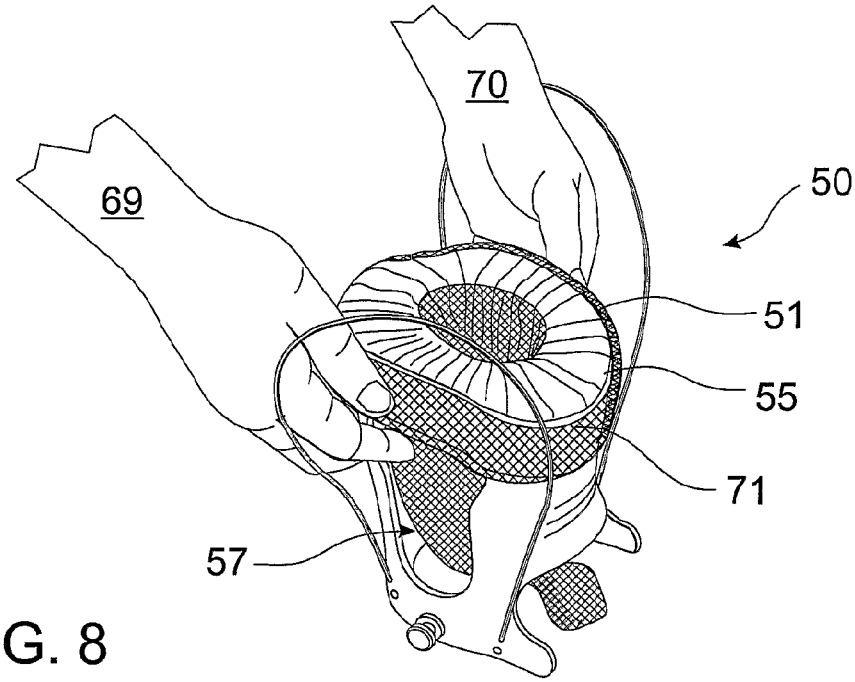
FIG. 8 shows embodiment of FIG. 7 being loaded with compression stocking.

FIG. 8 shows the commencement of application of a compression stocking to the applicator 50. A user, be it a patient or their carer lowers the compression stocking into the applicator then uses their hands 69, 70 to stretch the top inverted section 71 of a compression stocking over the lip 51. Commencing at the posterior section 55, the top section is stretched behind the flared lip over the intermediate section and downwardly over the notch 56. The lip should be adequately flared to keep the top section in place with retentive friction. The users fingers can slide easily into the slot and allow positive gripping and ergonomic advancement of the stocking.

Figure 9:
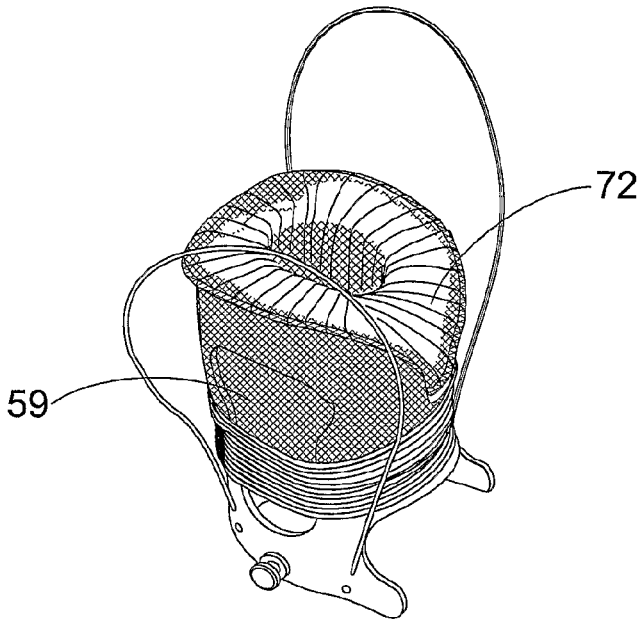
FIG. 9 shows the embodiment of FIG. 7 with the compression stocking fully loaded.

In FIG. 9 the stocking 72 is fully loaded. The expanded portion 59, 60 of the slot allows a user to get four fingers into the stocking to provide a good grasp of the material against the palm before it is urged downwardly to load up.

Figure 10:
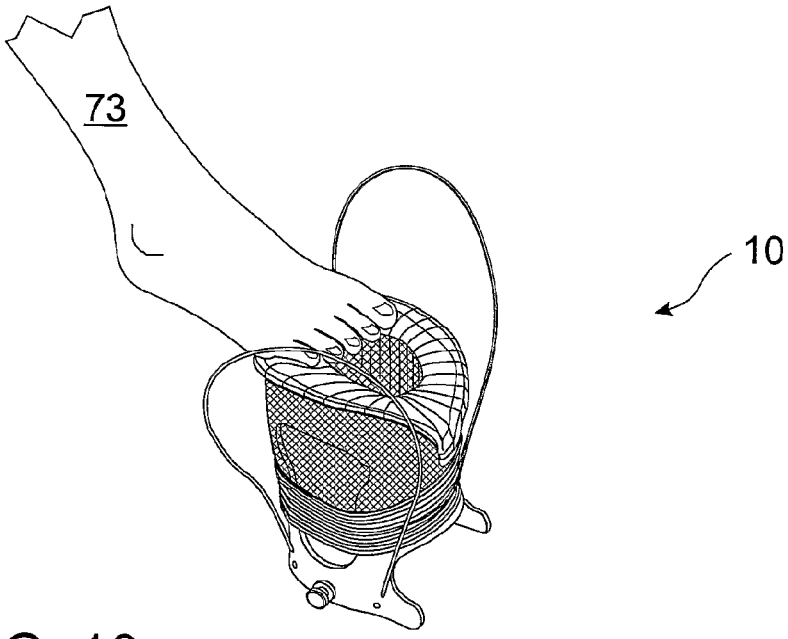
FIG. 10 shows a foot of a subject aligned for application of the stocking.

In FIG. 10 a foot 73 of a user is aligned with the loaded compression stocking.

Figure 11:
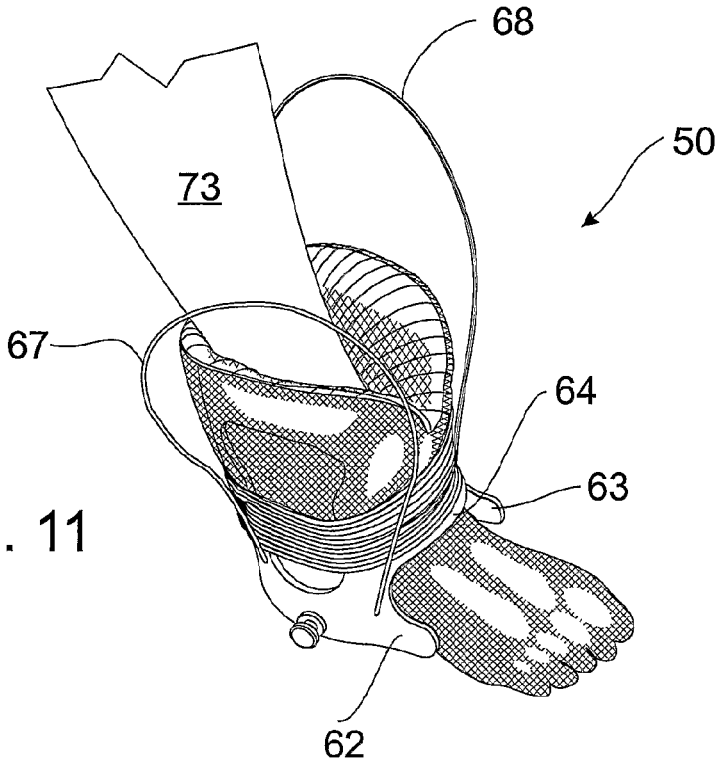
FIG. 11 shows the foot moved through a passageway in the applicator.
Figure 12:
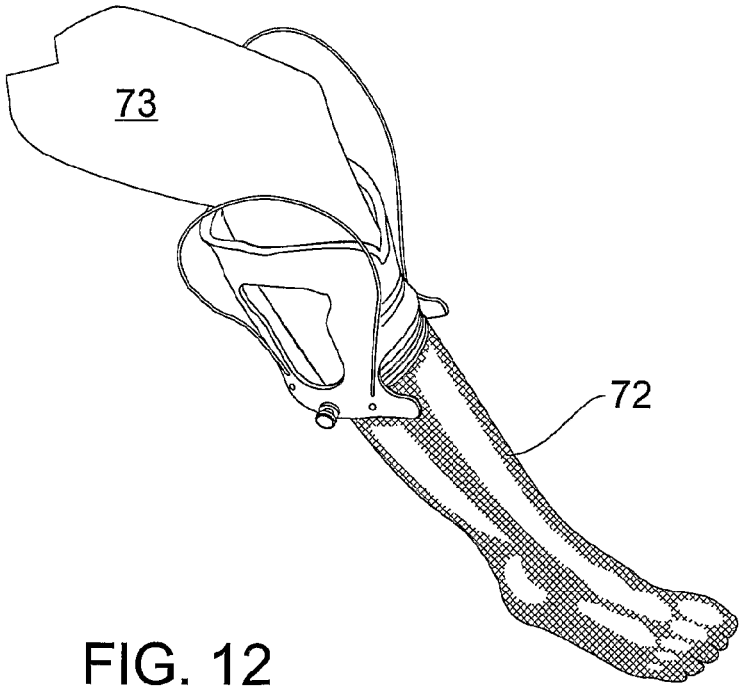
FIG. 12 shows the applicator advanced up the leg to discharge the compression stocking.

FIG. 11 shows the advantage of the foot arch 64 in that the users foot and ankle can naturally rotate forward avoiding any discomfort by hyperextension of the joint or friction with the inside wall of the applicator 50. The foot naturally and ergonomically slides down through the stocking and on to the ground to be flanked by the tongues 62, 63. The user then grasps the two handles 67, 68 and simply slides the applicator up the leg 73 as shown in FIG. 12. In the process the compression stocking 72 is unfurled and deposited in appropriate tension onto the leg 72. The applicator may be used for both below the knee and above the knee applications. A carer may use the handles rather than the patient if so desired or may simply grasp the body of the applicator with handles removed.

Figure 13:
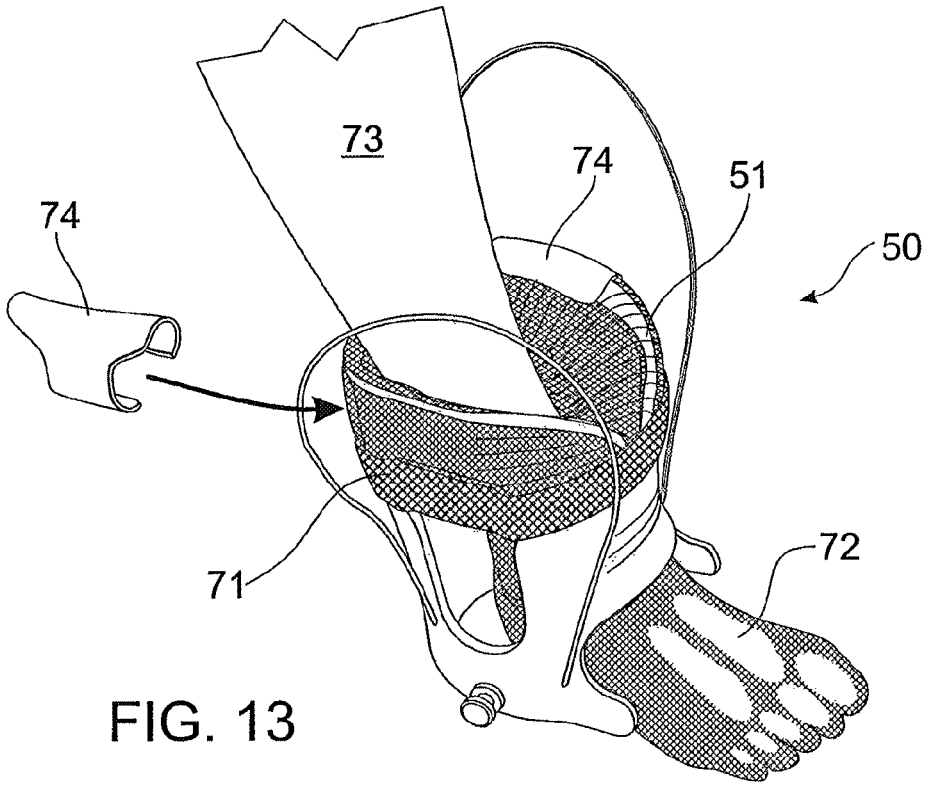
FIG. 13 shows the first step in removing the stocking using the applicator and retaining clips.
Figure 14:
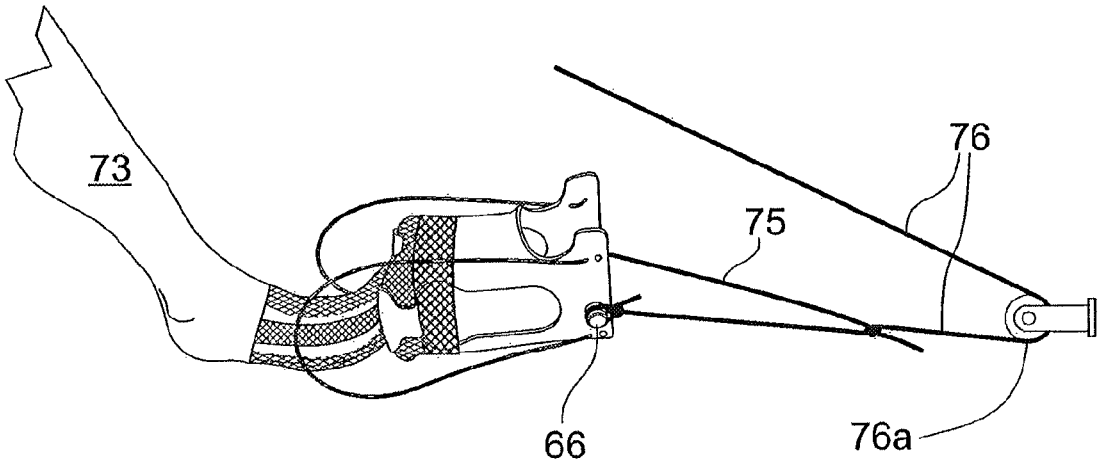
FIG. 14 shows a yoke in use to remove the applicator and stocking.

In seeking to remove the compression stocking, the same applicator 50 may be used as shown in FIG. 13. The leg 73 is positioned through the applicator 50 and the top section 71 of the compression stocking 72 is stretched outwardly and over the rim 51. Two removable clips 74 are snap locked into position between the lip 51 and corresponding slots. They thereby fix the top section 71 of the compression stocking to the applicator 51. A yoke 75 is shown in FIG. 14 attached to the two lugs 66 with the offside lug not apparent. The yoke may be attached by slip knots or other suitable means. Positive engagement may also be used. The yoke may be continuous with a tether or cord 76 which may be fixed to a static point so that a patient can retract their leg. Preferably, the tether is passed through a fixed pulley **76*a*** and back to the patient so they can simply use arm strength to remove the applicator together with the attached stocking. Application of traction on the base of the applicator removes the stocking. Other means of attachment may be used such as snap locks, shackles and the like with sufficient strength to remove the stocking.

The same modified device may also be beneficial when used on an arm of a patient.

Figure 15:
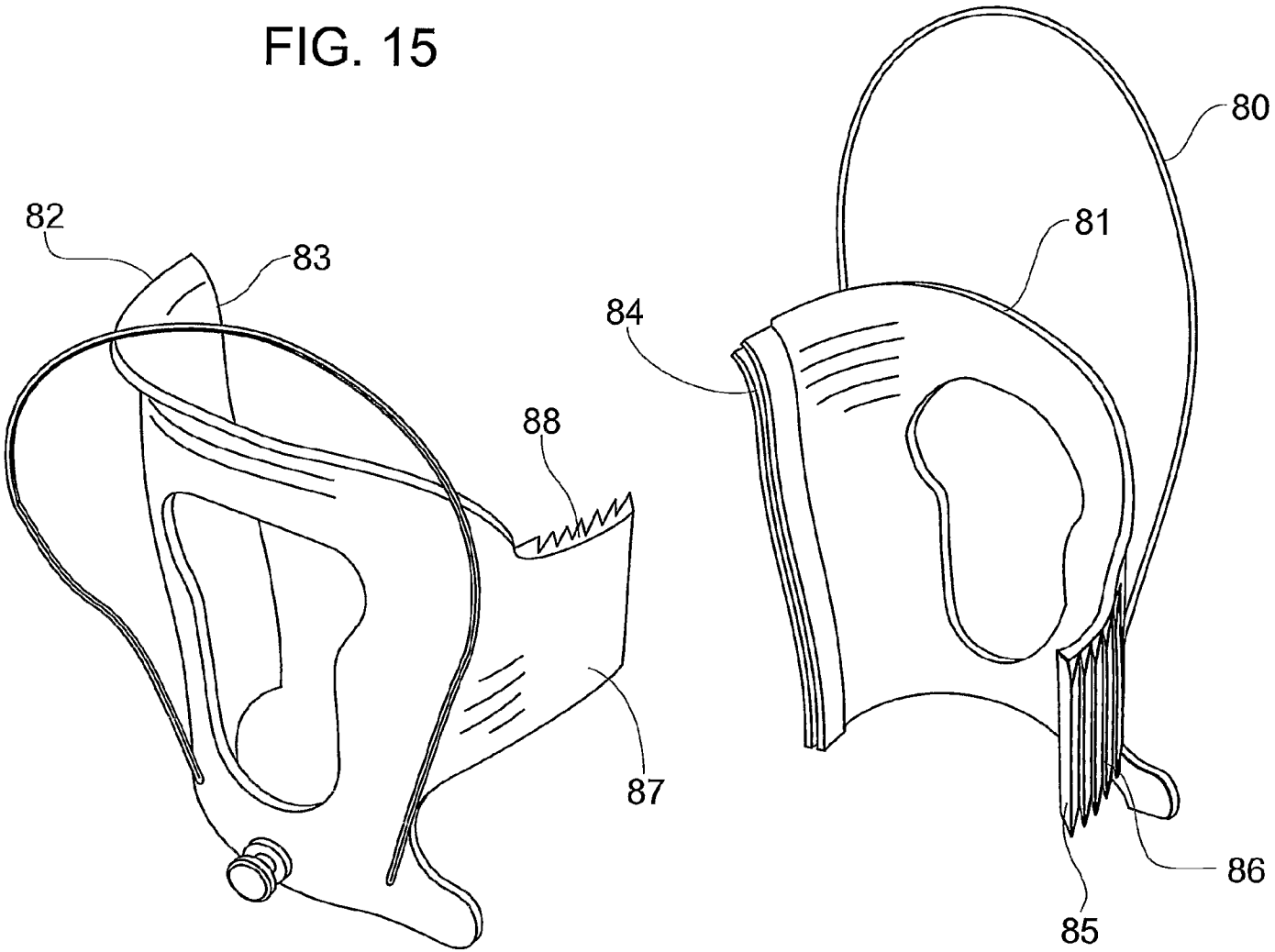
FIG. 15 is a perspective view of a further embodiment of an applicator of the present invention formed in two separable halves allowing for adjustment in applicator circumference for different sized patients.

FIG. 15 shows a third embodiment of an applicator 80 formed in two halves 81, 82. This provides for variable sizing and compact transport or storage of the applicator. A rearward edge 83 of the second half 82 mates with a slot 84 in the first half 81. The first half has a tongue 85 with outward facing teeth 86. The second half 82 has a corresponding tongue 87 with inward facing teeth 88. The tongues are formed so that they clip lock each over the other and lock the rearward edge 83 in position in the slot 84. The outer surface of the tongue 87 is smooth and provides a smooth outer surface for sliding of the compression stocking. The present arrangement also allows variation of the inner circumference of the applicator 80 to thereby better suit different size compression stockings and limbs of users.

The advantages of the present invention are readily apparent. A person may, unless severely disabled, apply their own compression stockings or bandages, particularly to the leg. This is also useful for an arm. Alternatively, a carer may use the present device for easy application with little risk of damage to the skin of the patient. A person wearing the compression stocking may put it on or remove it at will and may better suit the period of application to their particular therapeutic needs. Health workers will be called on less frequently and thereby provide a saving in both their time and economic outlay. The device is preferably made from a robust easily cleanable material that can be readily sterilised in the event of contamination with any bodily fluids. The flexible handles may be made to removably attach to the body which allows for their removal for use of the applicator by a carer or for cleaning. The handles may be formed from any material and any way that is suitable. They may even be formed as a solid or adjustable length handle.

The invention claimed is:

1. An applicator for applying a tubular compression member, the applicator comprising:

a rigid tubular body including an open top with a rim, the rim outwardly flared, at least in part;

an open base including an anterior passage for a foot of a person which is bracketed by forward reaching tongues;

a passageway between the base and top with sufficient dimensions to allow passage of the foot;

a side wall including two or more longitudinal slots therein, the two or more slots dimensioned to allow use of fingers and hands to load the rigid tubular body with a compression member; and a notch extending downwardly from the rim and extending only partially down a length of the rigid tubular body, wherein opposed sides of the notch converge in a downwardly direction.

2. The applicator of claim 1 wherein the body is cylindrical or oval.

3. The applicator of claim 2 wherein the body is formed from a polymeric material or metal.

4. The applicator of claim 1 wherein the body is formed in two separable inter-engagable parts.

5. The applicator of claim 4 wherein the dimensions of the passageway are variable.

6. The applicator of claim 1 wherein the rim is outwardly flared in a posterior section and in an anterior section.

7. The applicator of claim 6 wherein an intermediate section between the posterior section and anterior section is convex.

8. The applicator of claim 1 wherein the notch is an anterior notch.

9. The applicator of claim 1 wherein the longitudinal slots are diametrically opposed.

10. The applicator of claim 9 wherein an upper end of each slot is expanded.

11. The applicator of claim 1 wherein the base is adapted to support the body on a surface.

12. The applicator of claim 1 further comprising two spaced handles attached at or near the base, extending upwardly and dimensioned for gripping by the user.

13. The applicator of claim 12 wherein the handles are solid, adjustable in length, and removable.

14. The applicator of claim 1 further comprising a mounting mechanism at or near the base which receives a cord, to assist with removal of a compression member.

15. The applicator of claim 14 further comprising one or more opposing clamps for removably clamping a top section of the compression member to the top of the body sufficiently firmly to facilitate removal by traction on the body of the applicator.

16. The applicator of claim 15 wherein the clamps are adapted to mount outwardly and against the top of a corresponding slot.

17. The applicator of claim 16 further comprising a yoke for engagement with the mounting mechanism, a tether continuous with the yoke and a pulley or pulley system to redirect the tether from the foot past a static point and to the user for their operation in removal of the compression member.

* * * * *